US008695560B2

(12) United States Patent
Issler et al.

(10) Patent No.: US 8,695,560 B2
(45) Date of Patent: Apr. 15, 2014

(54) PISTON FOR AN INTERNAL COMBUSTION ENGINE

(75) Inventors: Wolfgang Issler, Schwaikheim (DE); Peter Kemnitz, Leutenbach (DE)

(73) Assignee: MAHLE International GmbH, Stuttgart (DE)

( * ) Notice: Subject to any disclaimer, the term of this patent is extended or adjusted under 35 U.S.C. 154(b) by 3 days.

(21) Appl. No.: 13/516,473

(22) PCT Filed: Dec. 17, 2010

(86) PCT No.: PCT/DE2010/001484

§ 371 (c)(1),
(2), (4) Date: Sep. 12, 2012

(87) PCT Pub. No.: WO2011/072657

PCT Pub. Date: Jun. 23, 2011

(65) Prior Publication Data

US 2013/0008407 A1 Jan. 10, 2013

(30) Foreign Application Priority Data

Dec. 18, 2009 (DE) ..... 10 2009 059 056

(51) Int. Cl.
*F02F 3/00* (2006.01)

(52) U.S. Cl.
USPC ..... 123/193.6; 92/239

(58) Field of Classification Search
CPC ..... F02F 2003/0061; F02F 2003/0015; F02F 2003/003; F02F 2003/0007; F02F 3/003; F02F 3/00
USPC ..... 123/193.6, 307, 671, 661; 92/239, 92/222–225
See application file for complete search history.

(56) References Cited

U.S. PATENT DOCUMENTS

| | | | | |
|---|---|---|---|---|
| 1,763,523 | A | | 6/1930 | Jardine |
| 4,727,795 | A | * | 3/1988 | Murray et al. ..... 92/189 |
| 4,989,559 | A | * | 2/1991 | Fletcher-Jones ..... 123/193.6 |
| 5,063,893 | A | * | 11/1991 | Iwaya ..... 123/193.6 |
| 5,144,923 | A | * | 9/1992 | Leites et al. ..... 123/193.6 |
| 5,309,818 | A | * | 5/1994 | Mendes et al. ..... 92/176 |

(Continued)

FOREIGN PATENT DOCUMENTS

| | | |
|---|---|---|
| DE | 199 08 670 | 11/2000 |
| DE | 199 35 410 | 2/2001 |

(Continued)

OTHER PUBLICATIONS

International Search Report of PCT/DE2010/001484, Apr. 13, 2011.

(Continued)

*Primary Examiner* — Hung Q Nguyen
(74) *Attorney, Agent, or Firm* — Collard & Roe, P.C.

(57) ABSTRACT

A piston for an internal combustion engine has a piston crown, a circumferential fire land, a circumferential ring part having annular grooves, and a piston skirt, which comprises two skirt walls and two box walls set back from the ring part and connecting the skirt walls in such a way that an exposed underside of the ring part is formed in the area of each of the box walls. The box walls are provided with pin bosses having pin bores. At least one support element is arranged between each exposed underside of the ring part and the box wall associated with the underside of the ring part.

10 Claims, 4 Drawing Sheets

(56) References Cited

U.S. PATENT DOCUMENTS

Figure 1:
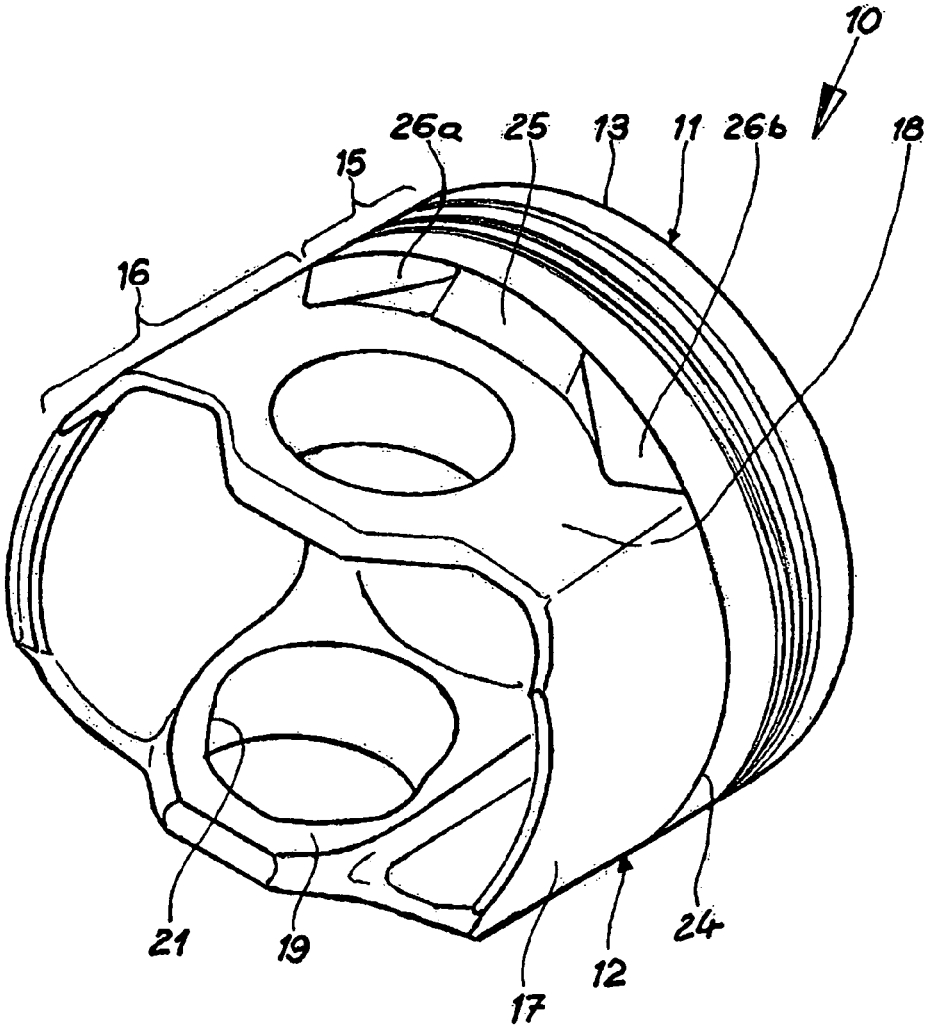

| | | | | |
|---|---|---|---|---|
| 5,839,407 | A | 11/1998 | Suzuki et al. | |
| 6,152,017 | A | 11/2000 | Harrer et al. | |
| 2004/0194621 | A1 | 10/2004 | Geissler | |
| 2008/0216790 | A1 | 9/2008 | Breidenbach et al. | |
| 2008/0264376 | A1 | 10/2008 | Braig et al. | |
| 2010/0065009 | A1 * | 3/2010 | Mukouhara et al. | 123/193.6 |
| 2010/0101527 | A1 | 4/2010 | Gniesmer | |

FOREIGN PATENT DOCUMENTS

| | | |
|---|---|---|
| DE | 101 06 578 | 8/2002 |
| DE | 10 2007 020 447 | 10/2008 |
| DE | 10 2008 018 850 | 6/2009 |
| EP | 0 251 393 | 1/1988 |
| EP | 0 838 587 | 4/1998 |
| GB | 2 347 194 | 8/2000 |
| JP | 2005-299484 | 10/2005 |
| WO | WO 2007/031188 | 3/2007 |
| WO | WO 2008/128611 | 10/2008 |

OTHER PUBLICATIONS

German Search Report dated Sep. 2, 2010 in German Application No. 10 2009 059 056.0 with English translation of the relevant parts.

* cited by examiner

PISTON FOR AN INTERNAL COMBUSTION ENGINE

CROSS REFERENCE TO RELATED APPLICATIONS

This application is the National Stage of PCT/DE2010/001484 filed on Dec. 17, 2010, which claims priority under 35 U.S.C. §119 of German Application No. 10 2009 059 056.0 filed on Dec. 18, 2009, the disclosure of which is incorporated by reference. The international application under PCT article 21(2) was not published in English.

The present invention relates to a piston for an internal combustion engine, having a piston crown, a circumferential top land, and a circumferential ring belt that has ring grooves, as well as having a piston skirt that has two skirt walls and two box walls that connect the skirt walls with one another, in such a manner that a freestanding underside of the ring belt is formed in the region of the box walls, in each instance, whereby the box walls are provided with pin bosses that have pin bores.

A piston of this type is known from the International Patent Application WO 2008/128611 A1. Pistons having this design are also called box pistons. In typical box pistons, two walls of the piston skirt that lie opposite one another are recessed with regard to the outer contour of the piston. The recessed walls are referred to as box walls; the two other non-recessed walls are the skirt walls and have the actual working surface of the piston skirt. The pin bosses with the pin bores are integrated into the box walls. The box walls and the skirt walls are connected with the underside of the piston crown.

In the case of such box pistons, the problem occurs that during engine operation, forces act on the piston, by means of the gas pressure and the ignition pressure, which are so great that deformations of the piston occur. It is particularly disadvantageous, in this connection, that the ring belt is supported only in the region of the skirt walls, but has a freestanding, overhanging underside in the region of the box walls. This has the result that the ring belt is clearly deformed in the direction of the crankcase, in the region of the box walls. In contrast, the ring belt in the region of the skirt walls is only deformed slightly, as the result of the rigid construction of the box walls and of the skirt walls. Therefore a jump in rigidity exists in the region in which the box walls make a transition into the skirt walls. As a result and because of the bending moment that occurs during deformation of the ring belt in the region of the box walls, stresses occur, by means of which the box piston is put under excessive stress. Particularly in the case that the box piston consists of an upper part and a lower part that are welded to one another, the weld seam is or the weld seams are put under particularly severe stress. In the case that the piston furthermore has a circumferential cooling channel in the region of the ring belt, the stability of the ring belt is further reduced by this, so that particularly clear deformation is observed during engine operation.

The task of the present invention therefore consists in further developing a box piston of the stated type, in such a manner that the stress caused by the bending moment that occurs in the region of the ring belt during engine operation is reduced.

The solution consists in that at least one support element is disposed between each freestanding underside of the ring belt and the box wall assigned to it.

It has surprisingly turned out that the stress that acts on the piston according to the invention is clearly reduced by means of connecting the freestanding undersides of the ring belt to the box walls, because the ring belt is less severely deformed in this region during engine operation. Particularly in the case of multi-part welded pistons, the stress on the weld seams is clearly reduced and the component safety is correspondingly increased. The need to reinforce the ring belt and/or to offset the box walls radially toward the outside is eliminated. The increase in weight of the box piston caused by the at least one support element is minimal.

Advantageous further developments are evident from the dependent claims.

An advantageous further development consists in that precisely one support element disposed above the pin bore is provided between each freestanding underside of the ring belt and the box wall assigned to it. Effective reduction of the bending is already achieved in that precisely one support element connects the ring belt to the box wall in the region of maximal bending of the ring belt.

Each support element can extend over the entire box wall in the circumferential direction. This results in particularly effective reinforcement of the ring belt.

A particularly preferred further development consists in that precisely two support elements are provided between each freestanding underside of the ring belt and the box wall assigned to it, which elements are disposed on both sides of the pin bore. As a result, very effective reinforcement of the ring belt in the region of the box walls is achieved, and, at the same time, an optimal relationship between reinforcement, on the one hand, and the weight of the piston, on the other hand, is achieved.

The support elements can extend over the box walls to such an extent that they enclose the pin bore, at least in part. As a result, the forces that act on the ring belt can be discharged into the box walls particularly effectively.

The support elements preferably extend over the entire radial width of the freestanding underside of the ring belt, in order to achieve particularly effective support.

In principle, the support elements can be configured in any desired manner. In this connection, their support effect is essential, as is the discharge of the forces that act on the ring belt. The support elements can be configured in rib shape or tetrahedral shape, for example. They are preferably triangular, trapezoid, or shaped as a circle segment in cross-section, in order to optimize the support effect and the transfer of force.

The present invention is suitable for all construction types of box pistons. It can particularly be used in multi-part pistons that have an upper piston part and a lower piston part that comprises the support elements, which are connected with one another by means of a suitable welding method. By means of the support elements according to the invention, the stress on the weld seams that is caused by the bending moments that occur during bending of the ring belt in the region of the box walls is clearly reduced, so that the component safety of such pistons is significantly improved. The tensions on the piston crown are also clearly reduced with this geometrical measure.

The piston can be produced from any desired material, particularly from an iron material.

Figure 2:
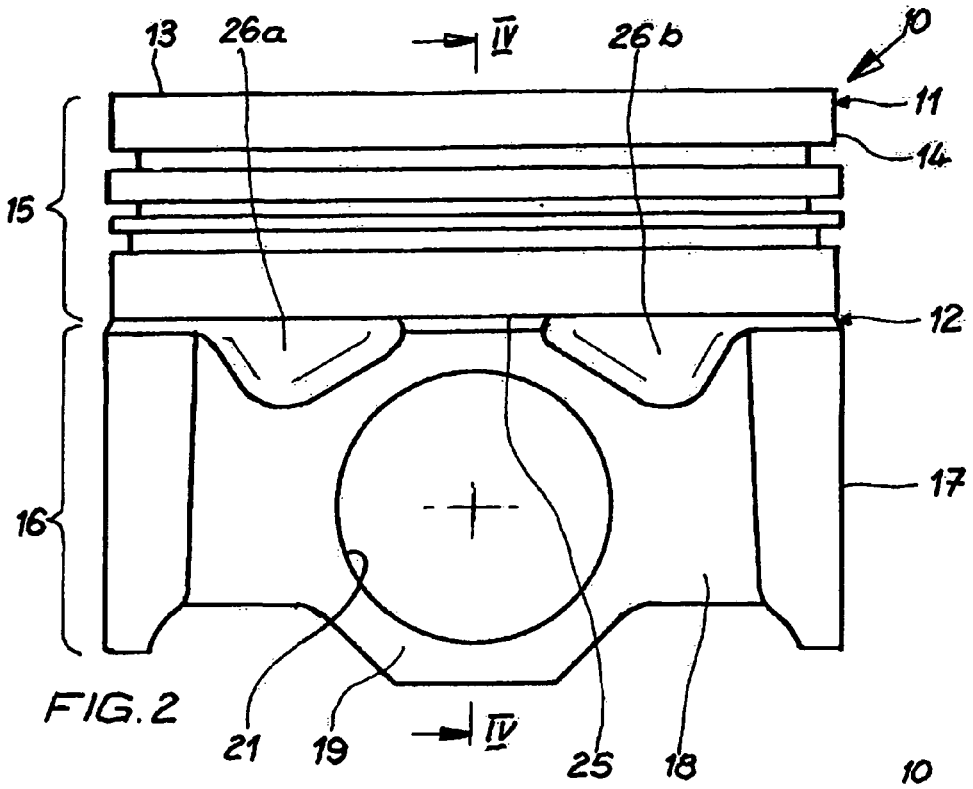
Figure 3:
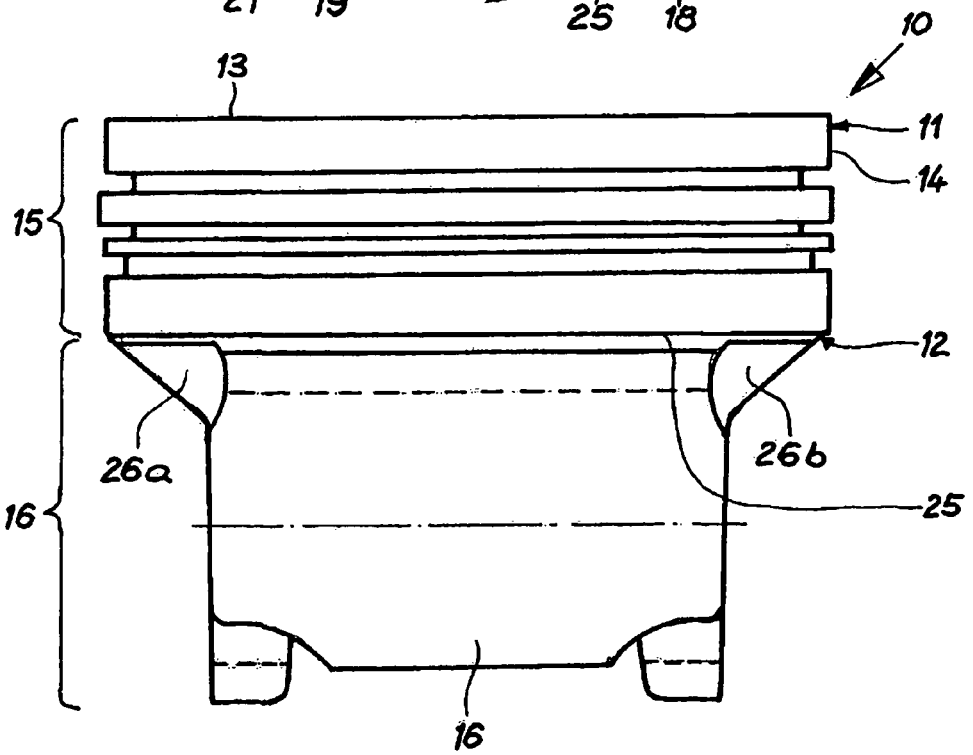
Figure 4:
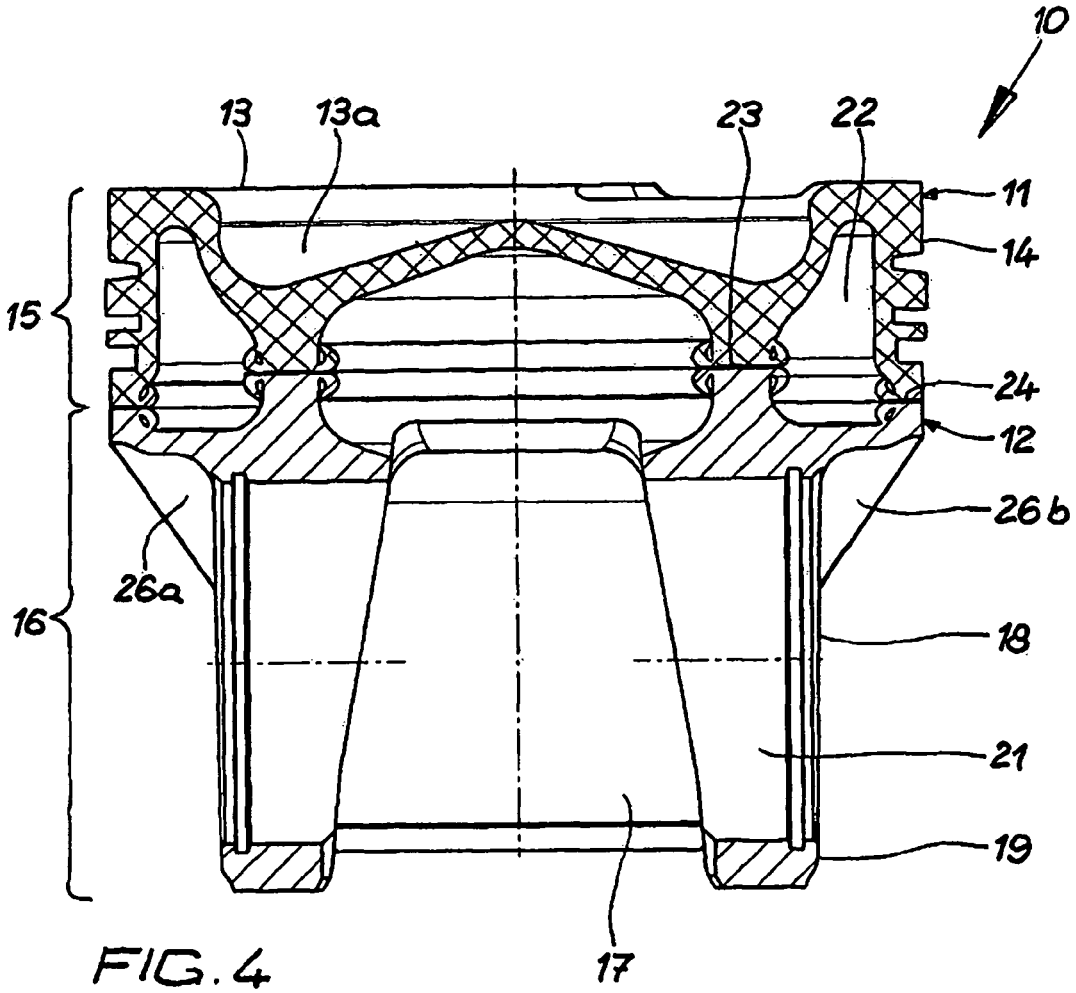

An exemplary embodiment of the present invention will be explained in greater detail in the following, using the attached drawings. These show, in a schematic representation, not true to scale:

FIG. 1 a perspective representation of an exemplary embodiment of a piston according to the invention;

FIG. 2 the piston according to FIG. 1 in a front view;

FIG. 3 the piston according to FIG. 1 in a side view, rotated by 90° as compared with FIG. 2;

FIG. 4 a section along the line IV-IV in FIG. 2; and

Figure 5:
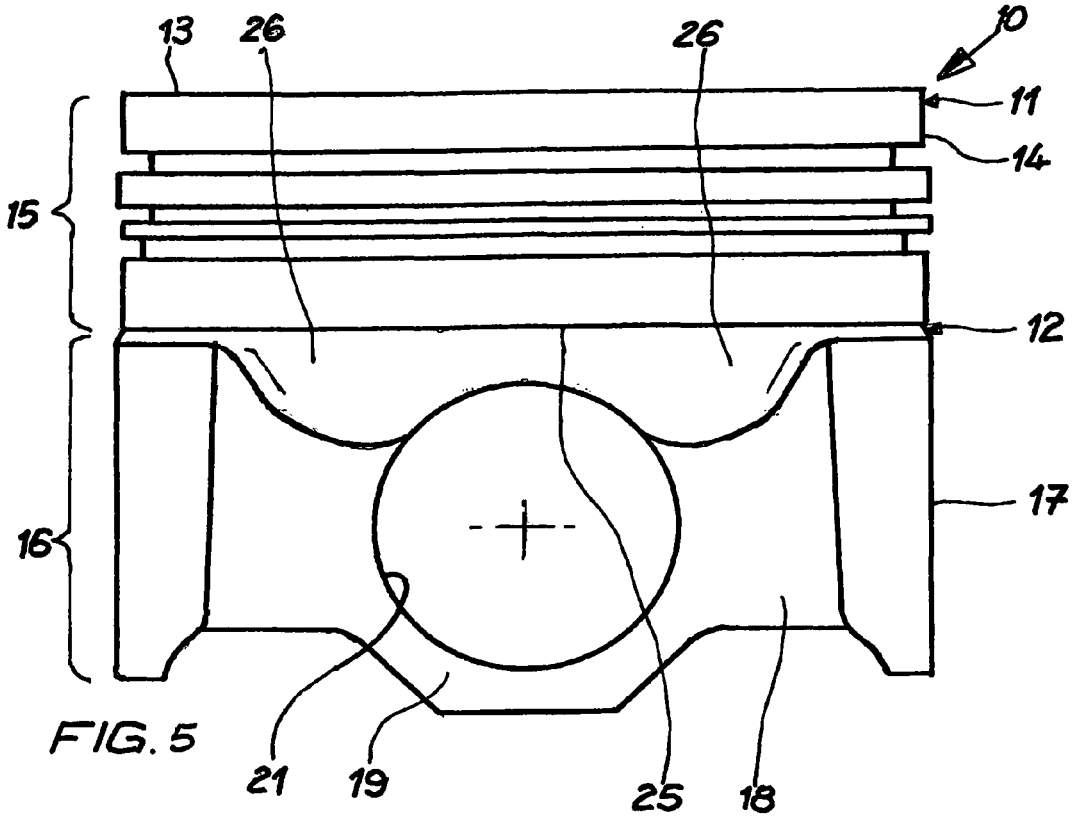

FIG. 5 a front view of an alternative embodiment of the piston according to the invention.

FIGS. 1 to 4 show an exemplary embodiment of a piston 10 according to the invention, which is produced from a steel material in the exemplary embodiment. In the exemplary embodiment, the piston 10 according to the invention is a two-part piston. It is composed of an upper piston part 11 and a lower piston part 12. The upper piston part 11 has a piston crown 13 with a combustion bowl 13*a* and a circumferential ring belt 15 that encloses a top land 14. The lower piston part 12 has a piston skirt 16 that is connected to the underside of the piston crown 13. The piston skirt 16 has two skirt walls 17 and two box walls 18 that are recessed relative to the ring belt 15 and connect the skirt walls 17. As a result, a freestanding underside 25 of the ring belt 15 is formed. The outer circumference area of each skirt wall 17 represents a working surface of the piston skirt 16. Each box wall 18 has a pin boss 19 provided with a pin bore 21.

In the region of the ring belt, the upper piston part 11 and the lower piston part 12 form a circumferential outer cooling channel 22.

In the exemplary embodiment, the upper piston part 11 and the lower piston part 12 are connected in known manner, by means of a suitable connection method, for example by means of friction welding. As a result, an inner circumferential weld seam 23 and an outer circumferential weld seam 24 are formed.

In the exemplary embodiment, each freestanding underside 25 of the ring belt 15 is connected with the box wall 18 assigned to it by means of two support elements 26*a*, 26*b*. In the exemplary embodiment, the support elements 26*a*, 26*b* are formed onto, for example forged onto the lower piston part 12 in one piece, and disposed on both sides of each pin bore 21. The support elements 26*a*, 26*b* are configured in approximately tetrahedral shape, with an approximately triangular cross-section, whereby the tip of each support element 26*a*, 26*b* is oriented toward the pin bore 21 of the box wall 18, in each instance. The base of each approximately tetrahedral support element 26*a*, 26*b* extends along the freestanding underside 25 of the ring belt 15 and is dimensioned in such a manner, in the exemplary embodiment, that each support element 26*a*, 26*b* extends over the entire radial width of the freestanding underside 25 of the ring belt 15 (see FIGS. 1 and 3).

Of course, only one support element 26 can also be provided, which is disposed above the pin bore 21, as shown in FIG. 5. In each case, the support elements bring about the result that the deformation of the ring belt 15 during engine operation is significantly reduced. As a result, the tensions that result from this deformation, which particularly occur in the transition region between each skirt wall 17 and each box wall 18, are also reduced. This leads to the result that the stress on the weld seams 23, 24 as well as on the piston crown is greatly reduced, and the component safety of the piston 10 according to the invention is clearly increased.

The invention claimed is:

1. Piston (10) for an internal combustion engine, having a piston crown (13), a circumferential top land (14), and a circumferential ring belt (15) that has ring grooves, as well as having a piston skirt (16) that has two skirt walls (17) and two box walls (18) that are recessed relative to the ring belt (15) and connect the skirt walls (17), in such a manner that a freestanding underside (25) of the ring belt (15) is formed in the region of each of the box walls (18), wherein the box walls (18) are provided with pin bosses (19) that have pin bores (21), wherein precisely two support elements (26*a*, 26*b*) are provided between each freestanding underside (25) of the ring belt (15) and the box wall (18) assigned to it, said support elements (26*a*, 26*b*) being disposed on both sides of the pin bore (21), and said support elements (26*a*, 26*b*) being configured in tetrahedral shape and extending over the entire box wall (18) in the circumferential direction.

2. Piston according to claim 1, wherein the support elements (26*a*, 26*b*) extend so far over the box walls (18) that they enclose the pin bore (21) at least in part.

3. Piston according to claim 1, wherein the support elements (26*a*, 26*b*) extend over the entire radial width of the freestanding underside (25) of the ring belt (15).

4. Piston according to claim 1, wherein the support elements (26*a*, 26*b*) are configured to be triangular, trapezoid, or in the shape of a circular segment in cross-section.

5. Piston according to claim 1, wherein the piston has an upper piston part (11) and a lower piston part (12) comprising the support elements (26*a*, 26*b*), said upper piston part (11) and said lower piston part (12) being connected with one another by means of welding.

6. Piston according to claim 1, wherein the piston (10) is produced from an iron material.

7. Piston (10) for an internal combustion engine, having a piston crown (13), a circumferential top land (14), and a circumferential ring belt (15) that has ring grooves, as well as having a piston skirt (16) that has two skirt walls (17) and two box walls (18) that are recessed relative to the ring belt (15) and connect the skirt walls (17), in such a manner that a freestanding underside (25) of the ring belt (15) is formed in the region of each of the box walls (18), wherein the box walls (18) are provided with pin bosses (19) that have pin bores (21), wherein precisely one support element (26) disposed above the pin bore (21) is provided between each freestanding underside (25) of the ring belt (15) and the box wall (18) assigned to the ring belt, wherein the support element (26) extends over the entire radial width of the freestanding underside (25) of the ring belt (15).

8. Piston according to claim 7, wherein the support element (26) extends over the entire box wall (18) in the circumferential direction.

9. Piston according to claim 7, wherein the piston has an upper piston part (11) and a lower piston part (12) comprising said support element (26) at each box wall (18), said upper piston part (11) and said lower piston part (12) being connected with one another by means of welding.

10. Piston according to claim 7, wherein the piston (10) is produced from an iron material.

* * * * *

UNITED STATES PATENT AND TRADEMARK OFFICE

CERTIFICATE OF CORRECTION

PATENT NO. : 8,695,560 B2
APPLICATION NO. : 13/516473
DATED : April 15, 2014
INVENTOR(S) : Issler et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 4 days.

Signed and Sealed this
Twenty-ninth Day of September, 2015

Michelle K. Lee

Michelle K. Lee
*Director of the United States Patent and Trademark Office*